United States Patent [19]

Graalmann et al.

[11] 4,194,515

[45] Mar. 25, 1980

[54] METHOD AND APPARATUS FOR CONDITIONING BURLEY OR GREENLEAF TOBACCO

[75] Inventors: Gerhard Graalmann, Wohltorf; Reinhard Hohm, Pinneberg; Peter Schwarz, Rellingen; Wilfried Muhsil, Hamburg, all of Fed. Rep. of Germany

[73] Assignee: Hauni-Werke Körber & Co. KG., Hamburg, Fed. Rep. of Germany

[21] Appl. No.: 835,489

[22] Filed: Sep. 22, 1977

[30] Foreign Application Priority Data

Oct. 21, 1976 [DE] Fed. Rep. of Germany ..... 2647438

[51] Int. Cl.[2] ..... A24B 3/10; A24B 3/12

[52] U.S. Cl. ..... 131/135; 131/136; 131/138; 131/140 R

[58] Field of Search ..... 34/48, 36, 216, 51, 34/54; 131/135, 136, 133, 137, 138, 140 R; 432/500

[56] References Cited

U.S. PATENT DOCUMENTS 3,799,176 3/1974 Wochnowski ..... 131/135

3,877,469 4/1975 Wochnowski et al. ..... 131/136

4,004,594 1/1977 Wochnowski et al. ..... 131/135

*Primary Examiner*—V. Millin

*Attorney, Agent, or Firm*—Peter K. Kontler

[57] ABSTRACT

A continuous stream of burley or greenleaf tobacco is transported through a first and thereupon through a second heating unit wherein the particles of tobacco are heated by ascending currents of hot air supplied at a pressure and rate such that the respective portions of the stream are fluidized. First and second detectors are provided to measure the temperature of tobacco downstream of the first and second heating units. Signals from the detectors are used to regulate the temperature of the respective air currents. The temperature of air current which is admitted into the second heating unit is further regulated in dependency on deviation of signals furnished by the detector behind the first heating unit from a reference signal denoting the desired temperature of once heated tobacco. The temperature of each current of hot air is further regulated in dependency on the monitored temperature of air which is about to enter the first and second heating units.

10 Claims, 3 Drawing Figures

BLOWER
SERVO-MOTOR
TEMPERATURE MONITORING DEVICE
AMPLIFIER
PID-CIRCUIT
DETECTOR
AMPLIFIER
OUTPUT AMPLIFIER
SIGNAL COMPARING STAGE
SENSOR
SOURCES OF REFERENCE SIGNALS
AMPLIFIER
DETECTOR (BOLOMETER)

METHOD AND APPARATUS FOR CONDITIONING BURLEY OR GREENLEAF TOBACCO

BACKGROUND OF THE INVENTION

The present invention relates to a method and apparatus for conditioning tobacco, especially burley or greenleaf tobacco. More particularly, the invention relates to improvements in methods and apparatus for reducing the moisture content of tobacco to a desired value which is best suited for further processing. Still more particularly, the invention relates to improvements in methods and apparatus for reducing the moisture content from a relatively high value to a small fraction of such value while the material to be conditioned is conveyed in the form of a continuous stream.

It is already known to regulate the conditioning action upon burley tobacco by ascertaining its temperature immediately downstream of a zone where the tobacco is subjected to a very pronounced heating action and by altering the rate of admission of heat energy in dependency on deviations of ascertained temperature from a desired value. The temperature of tobacco is ascertained indirectly, namely by comparing the temperature of a stream of hot air prior and subsequent to exchange of heat energy with tobacco. The apparatus for carrying out such measurements includes a first detector serving to monitor the temperature of hot air which is about to contact the tobacco particles and a second detector which monitors the temperature of such air subsequent to heat energy exchange with tobacco. The just described apparatus exhibits the advantage that deviations, if any, from desired moisture content are detected practically immediately so that the percentage of improperly dried burley tobacco is low. A drawback of the apparatus is that the temperature of tobacco is ascertained in a roundabout way which is evidently less reliable than direct measurements. It can be said that such conventional apparatus is sufficiently reliable to insure that the final moisture content will not deviate appreciably from the desired moisture content; however, the apparatus cannot always insure that the final moisture content will be within a rather narrow optimum range. Such accurate drying is desirable because heated tobacco is thereupon cooled and is admitted into a moisturizing unit wherein the moisture content rises to a value which is best suited for further processing. Accurate and predictable changes of moisture content from the relatively low moisture content after drying to the optimum moisture content can be effected (or are less complex and expensive) only if the heating action has resulted in a reduction of moisture content to a predetermined value or is within a narrow range including such predetermined value.

OBJECTS AND SUMMARY OF THE INVENTION

An object of the invention is to provide a novel and improved method of reducing the moisture content of tobacco, particularly burley or greenleaf tobacco, to a value which is within a very narrow range, even if the moisture content must be reduced from a relatively high value to a small fraction (e.g., one-third or one-fourth) of such value.

Another object of the invention is to provide a method which insures that each and every increment of a continuous tobacco stream can be conditioned to the same extent, even if one or more intermediate stages of conditioning deviate from the desired rate.

A further object of the invention is to provide a relatively simple, compact and inexpensive apparatus which can be used for the conditioning of tobacco, especially burley or greenleaf tobacco, with a higher degree of predictability than in heretofore known apparatus.

An additional object of the invention is to provide an apparatus which can rapidly reduce the moisture content of tobacco to a fraction of the initial moisture content, even if the initial moisture content is as high as 50 percent or more.

An ancillary object of the invention is to provide novel and improved means for regulating the rate of admission and/or the temperature of heating medium for burley or greenleaf tobacco in the above outlined apparatus.

Another object of the invention is to provide an apparatus which can be readily adjusted to reduce the moisture content of tobacco to any one of a wide range of values.

One feature of the invention resides in the provision of a method of reducing the moisture content of tobacco, especially burley or greenleaf tobacco. The method comprises the steps of transporting a continuous stream of moist tobacco along a predetermined path, e.g., along a substantially horizontal path, subjecting successive increments of the stream to a first variable or adjustable heating action in a first portion of the path, measuring the temperature of tobacco downstream of the first portion of the path, comparing the measured temperature with a first reference value which denotes the desired or optimum temperature of tobacco downstream of the first portion of the path, adjusting the first heating action when the measured temperature deviates from the reference value, subjecting successive increments of the stream to a second variable or adjustable heating action in a second portion of the path downstream of the first portion, measuring the temperature of tobacco downstream of the second portion of the path, comparing the measured temperature of twice heated tobacco with a second reference value which denotes the desired or optimum temperature downstream of the second portion of the path, adjusting the second heating action when the measured temperature (downstream of the second portion of the path) deviates from the second reference value, and adjusting the second heating action when the measured temperature of once heated tobacco (downstream of the first portion of the path) deviates from the first reference value so as to intensify the second heating action when the measured temperature downstream of the first portion of the path is less than the first reference value and vice versa.

At least one step of subjecting tobacco to an adjustable heating action comprises or may comprise conveying a heated gas (e.g., air) upwardly across the tobacco stream in the respective portion of the path at a rate and pressure such as to convert the respective portion of the stream into a fluidized stream wherein at least some constituents of the stream float in the ascending gas.

Regardless of whether the hot gas is conveyed across the first or second portion of the path, the method preferably further comprises the steps of monitoring the temperature of heated gas prior to admission into the respective portion of the path and adjusting the respective heating action as a function of the monitored temperature of hot gas. For example, a signal which denotes the difference between the measured temperature of tobacco downstream of the one portion of the path and the desired value of such temperature can be compared with the signal which denotes the temperature of hot gas prior to admission into the respective portion of the path, and the temperature of hot gas (and hence the temperature of tobacco leaving the path portion wherein tobacco is heated by hot gas) is adjusted in dependency on the difference between the first mentioned signal and the signal denoting the temperature of hot gas.

It has been found that heating with hot gas is particularly suited for the practice of our method because the gas can effect intensive, rapid and uniform drying of tobacco in the respective portion or portions of the path, especially if the gas is supplied at the aforementioned rate and pressure, i.e., so that the corresponding portion of the tobacco stream is fluidized by causing some or all of its particles to float in the ascending gas without, however, permitting entrainment of floating particles from the corresponding portion of the path.

The novel features which are considered as characteristic of the invention are set forth in particular in the apended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figures 1, 2, 3:
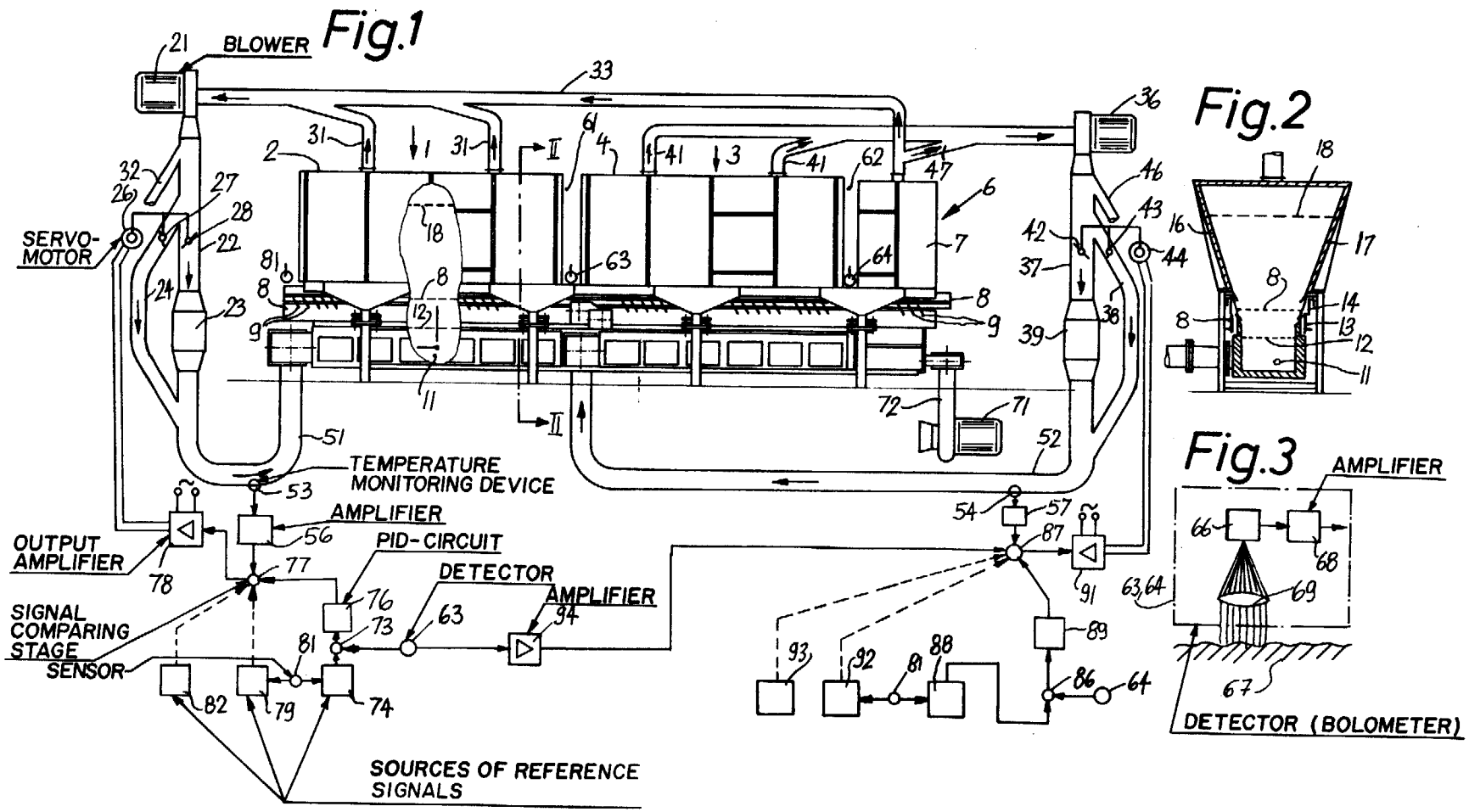
FIG. 1 is a schematic partly elevational and partly sectional view of a conditioning apparatus which is equipped with two heating units and one cooling unit and is constructed and assembled in accordance with the invention.
FIG. 2 is a transverse vertical sectional view as seen in the direction of arrows from the line II—II of FIG. 1.
FIG. 3 is an enlarged view of a detail in the apparatus of FIG. 1.

The drawing shows a conditioning apparatus for burley or greenleaf tobacco which includes two drying or heating units 1 and 3, and a cooling unit 6. These units respectively comprise transporting devices 2, 4 and 7 which serve to advance a continuous stream of tobacco particles along a predetermined path in a direction from the left to the right, as viewed in FIG. 1. The exact construction of the transporting devices 2, 4 and 7 forms no part of the present invention; they are similar or analogous to those disclosed in commonly owned U.S. Pat. Nos. 3,799,176 and 3,877,469 respectively granted to Wochnowski and Wochnowski et al. on Mar. 27, 1974 and Apr. 15, 1975. Therefore, the drawing merely shows certain components of such transporting devices.

The transporting device 2 of the drying unit 1 comprises a vibratory conveyor 8 which is mounted on arms 9 and is driven by a suitable prime mover through the medium of an eccentric or the like to perform oscillatory movements at a selected frequency. The bottom wall of the conveyor 8 has apertures for the passage of ascending streamlets of heating fluid (normally air) from a compartment 11 below the conveyor 8. The compartment 11 contains a fixedly mounted distributor 12 here shown as a perforated plate which is made of sheet metal or the like and insures uniform distribution of streamlets of hot air passing toward and through the apertures of the conveyor 8. The conveyor 8 comprises a lower portion 13, a trough-shaped upper portion 14 and upwardly extending divergent side walls 16, 17. A screen 18 is placed between the upper portions of the side walls 16, 17 to prevent escape of tobacco particles with ascending streamlets of hot air. The frequency and extent of oscillation of the conveyor 8 are related to the angle of divergence of the side walls 16 and 17 in such a way that particles of tobacco advancing above the apertured bottom wall of the conveyor 8 form a fluidized stream so that all sides of every or practically every tobacco particle are in contact with heating fluid whose speed decreases during upward movement between the side walls 16 and 17. Such conversion of a stream of closely adjacent tobacco particles into a fluidized stream insures a highly reliable, intensive, uniform and reproducible drying action within a small area.

The construction of the transporting device 4 is preferably identical with that of the device 2. The sole important difference between the devices 2, 4 on the one hand and the transporting device 7 on the other hand is that the latter forms a fluidized stream wherein the particles of tobacco are contacted by ascending streamlets or currents of a cool gaseous fluid, preferably air.

The means for admitting hot fluid to the compartment 11 of the first drying unit 1 comprises a blower 21 which conveys a stream of air through a pipe 22 containing a heating device 23. The pipe 22 has a bypass branch 25 wherein cool air can flow around the heating device 23 to be mixed with heated air issuing from 23. The pipe 22 and its branch 24 respectively contain flow regulating valves 28, 27 (e.g., pivotable flaps) whose position can be adjusted by a servomotor, e.g., a small electric motor 26. The motor 26 can cause the valves 27 and 28 to change the ratio of heated to unheated air in the pipe 22 downstream of the heating device 23. The intake of the blower 21 is connected with return conduits 31 which collect heated air rising between the side walls 16, 17 of the drying unit 1. The reference character 32 denotes an evacuating pipe. A further pipe 33 admits preheated fresh air into the intake of the blower 21 at a rate which suffices to compensate for the outflow of air via pipe 32.

The compartment 11 of the second drying unit 3 receives hot air from the outlet of a second blower 36 whose intake receives air from the unit 3 via return conduits 41 and some preheated fresh air from the cooling unit 6 via branch 47 of the pipe 33. The outlet of the blower 36 is connected with a pipe 37 containing a heating device 39 and including a branch 38 which bypasses the heating device 39. The pipe 37 and its branch 38 respectively contain pivotable regulating valves 42, 43 whose angular position can be adjusted by a servomotor 44. A pipe 46 evacuates some of the spent air from the pipe 37 upstream of the heating device 39, and such air is replaced by air entering the blower 36 via branch 47.

The pipes 22 and 37 respectively admit hot air into pipes 51, 52 which are connected with the compartments 11 of drying units 1 and 3. The pipes 51, 52 respectively contain temperature monitoring devices 53 and 54 which transmit signals denoting the temperature of hot air streams respectively flowing into the drying units 1 and 3. The monitoring devices 53, 54 may constitute conventional semiconductors of the type customary in such apparatus. The signals which are generated by monitoring devices 53, 54 are respectively transmitted to amplifiers 56 and 57. A tobacco temperature measuring device or detector 63 is disposed in a gap 61 between the units 1 and 3 to determine the temperature of tobacco entering the transporting device 4. An additional tobacco temperature measuring device or detector 64 in the gap 62 between the units 3 and 6 serves to determine the temperature of tobacco which is about to enter the transporting device 7. The detectors 63 and 64 are so-called bolometers (see FIG. 3) each of which includes a thermometer 66 sensitive to infrared radiation and spaced apart from the path for tobacco particles 67. A lens 69 is disposed between such path and the respective thermometer 66 to focus infrared rays upon the sensitive surface of 66. An amplifier 68 is connected between the output of the thermometer 66 and other components of the respective control circuit. For the sake of clarity, the detectors 63 and 64 are shown twice in FIG. 1, first in the respective gaps 61, 62 and again in the corresponding control circuits which respectively serve to transmit signals to the servomotors 26 and 44.

The compartment 11 of the cooling unit 6 receives a stream of atmospheric air from the outlet of a blower 71 by way of a pipe 72. Cool air which enters the path of tobacco particles 67 in the unit 7 exchanges heat energy with tobacco so that its temperature rises. The aforementioned pipe 33 and its branch 47 admit such heated air to the blowers 21 and 36.

The control circuit for the servomotor 26 comprises a signal comparing stage 73 which receives signals from the detector 63 and from a source 74 of reference signals (e.g., an adjustable potentiometer). When the intensity or another characteristic of signals transmitted by the detector 63 deviates from the corresponding characteristic of the reference signal from 74, the stage 73 transmits a signal to a conventional PID-circuit 76 which, in turn, transmits the signal to a second signal comparing stage 77. The stage 77 further receives signals from the temperature monitoring device 53 via circuit 56. The stage 77 is connected with the servomotor 26 by means of an output amplifier 78. The servomotor 26 is reversible, i.e., the direction in which the valves 27 and 28 are caused to pivot depends on the (positive or negative) sign of the signal at the output of the stage 77. It will be seen that the temperature of hot air in the pipe 51 can be changed in dependency on the intensity of signals furnished by the detector 63 and monitoring device 53.

The reference character 79 denotes a source of reference signals which is connected with a sensor 81. The latter detects the presence or absence of tobacco in the apparatus and is connected between the sources 74 and 79. The arrangement is such that the source 79 determines the intensity of signals furnished to the amplifier 78 via stage 77 when the apparatus is empty; the source 74 is then disconnected from the stage 73. A further source 82 of reference signals transmits a reference signal to the stage 77 during starting of the apparatus, i.e., while the units 1, 3 and 6 are in the process of receiving tobacco.

The construction of the control circuit for the servomotor 44 is analogous to that of the just described circuit. The three sources of reference signals (corresponding to 74, 79 and 82) are shown at 88, 92 and 93. The sensor 81 transmits signals in response to detection of absence of tobacco and then disconnects the source 88 from the signal comparing stage 86 which is connected with the detector 64 and with the stage 87 (by way of a PID-circuit 89). The stage 87 is connected with the monitoring device 54 via amplifier 57 and with the servomotor 44 via output amplifier 91.

The broken lines between the sources 79, 82 and 92, 93 on the one hand, and the signal comparing stages 77, 87 on the other hand, denote that the sources 79, 82, 92 and 93 transmit signals only at certain times, namely, in the absence of tobacco or during starting.

The detector 63 for tobacco issuing from the drying unit 1 is connected with the stage 87 by an amplifier 94.

The operation is as follows:

When a stream of greenleaf or burley tobacco passes through the apparatus, the sensor 81 activates the sources 74 and 88 of reference signals, i.e., these sources transmit signals to the stages 73, 86. The signal from 74 denotes the desired or optimum temperature of tobacco particles 67 which issue from the drying unit 1, and the signal from 88 denotes the desired or optimum temperature of tobacco particles issuing from the drying unit 3. Successive increments of the tobacco stream in the unit 1 are traversed by streamlets of hot air which flow upwardly through the apertures of the bottom wall of the conveyor 8. The ascending streamlets convert the tobacco stream into a fluidized stream wherein the heavier particles are nearer to the bottom and the lighter particles form a top stratum. As explained above, the streamlets of hot air are furnished by the pipe 51 which receives air from the pipe 22; air issuing from the pipe 22 is a mixture of heated air that has passed through the heating device 23 and of cooler air which has bypassed the device 23 via branch 24.

The divergent walls 16, 17 in the unit 1 decelerate the ascending streamlets of hot air above the fluidized stream so that the streamlets cannot entrain lighter tobacco particles on their way toward the return conduits 31. Any lighter particles which might have risen well above the fluidized stream are intercepted by the screen 18. The conduits 31 admit air into the intake of the blower 21. Some air issuing from the blower 21 is discharged via pipe 32, and such air is replaced by preheated fresh air admitted via pipe 33. Fresh air which is admitted via pipe 33 is preheated by tobacco particles 67 passing through the cooling unit 6.

The detector 63 determines the temperature of tobacco which issues from the drying unit 1 and transmits signals to the signal comparing stage 73 as well as to the stage 87 (via amplifier 94). The stage 73 transmits a signal to the PID-circuit 76 whenever the intensity of signal from 63 deviates from the intensity of reference signal furnished by the source 74. The stage 77 compares the signals which are transmitted by the circuit 76 with signals furnished by the monitoring device 53 and transmits a signal to the amplifier 78 whenever the intensity of signal from 76 exceeds or is less than the intensity of signal which is transmitted by the amplifier 56. The amplifier 78 then causes the servomotor 26 to effect an appropriate adjustment of valves 27 and 28, i.e., these valves cause the temperature of air in the pipe 51 to rise when the temperature of tobacco leaving the drying unit 1 is too low and vice versa. The circuit including the stages 73 and 77 insures that the temperature of tobacco particles 67 which advance from the unit 1 toward and into the unit 3 is constant or practically constant and matches or very closely approximates the desired optimum value (selected by adjustment of the source 74).

Signals which are transmitted by the detector 63 influence the adjustment of servomotor 44 via amplifier 94, signal comparing stage 87 and amplifier 91. As explained above, the setting of valves 42, 43 in the pipe 37 and its branch 38 (and hence the temperature of hot air in the pipe 52) is further influenced by signals from the detector 64 between the units 3 and 6 as well as by signals which are transmitted by the temperature monitoring device 54 via amplifier 57. Thus, the temperature of the air stream flowing into the compartment of the unit 3 is adjusted as a function of the temperature of tobacco particles 67 between the units 1 and 3, as a function of the temperature of tobacco particles 67 between the units 3 and 6, and as a function of actual temperature of hot air in the pipe 52. The streamlets of hot air which rise in the unit 3 convert the particles 67 of tobacco into a fluidized stream and remove additional moisture before entering the conduits 41 to flow toward and into the intake of the blower 36. Spent air which is discharged via pipe 46 is replaced with preheated air which is admitted to the blower 36 via branch 47.

The connection between the detector 63 and signal comparing stage 87 insures rapid and effective changes of heating action in the unit 3 as soon as the detector 63 begins to transmit signals which indicate that the temperature of tobacco particles 67 leaving the drying unit 1 is unsatisfactory. This will be readily appreciated since the temperature of hot air in the pipe 52 is altered before the increments whose temperature is unsatisfactory (determined by detector 63) advance beyond the second drying unit 3. In other words, automatic remedial action (change of temperature of hot air in the pipe 52) is undertaken before the respective increment or increments of the tobacco stream leave the second drying unit 3. The function of the second detector 64 is to effect (if necessary) additional and relatively minor changes of the temperature of hot air in the pipe 52 when the final temperature of heated tobacco leaving the second drying unit 3 deviates from that which is selected by the setting of the source 88. The detector 64 is particularly effective to eliminate long-range fluctuations or deviations of actual temperature of tobacco particles from the desired optimum temperature.

Tobacco particles which leave the second drying unit 3 enter the cooling unit 6 wherein the streamlets of ascending cool air convert the tobacco stream into a fluidized stream on its way to a take-off conveyor (not shown) which transports conditioned tobacco to a further processing station. Cool air which contacts the particles of fluidized stream in the unit 6 is caused to rise and to enter the pipe 33 and its branch 47 for admission into the intakes of the blowers 21 and 36.

Burley tobacco which issues from the cooling unit 7 is thereupon admitted into a moisturizing unit, not shown.

The improved apparatus can be used with advantage for conditioning of tobacco whose initial moisture content is very high, e.g., between 40 and 50 percent, by reducing the moisture content to between 12 and 14 percent. Such final moisture content is satisfactory for many types of processing of burley or greenleaf tobacco. It has been found that, in spite of the very pronounced difference between the initial and final moisture content, the improved apparatus is capable of insuring uniform and predictable drying of large quantities of tobacco particles per unit of time.

Applicants are aware of a prior proposal to determine the difference between the temperature of a hot gas which is about to be admitted into a first drying unit and the temperature of the same gas after it leaves the first unit, and to utilize the results of such measurements to regulate a device which controls the heating action in a second drying unit. However, the just mentioned prior proposal does not suggest the drying of burley or greenleaf tobacco (the characteristic curves denoting the temperature and the moisture content of burley or greenleaf tobacco during heating deviate considerably from the corresponding characteristic curves of other types of tobacco). Furthermore, such prior proposal is inferior to the method and apparatus of the present invention because it does not suggest to determine the temperature of tobacco downstream of each heating zone. Still further, the results of measurements in the first heating unit of the known apparatus merely influence the condition of heating medium in the second unit in dependency on the condition of heating medium which is used in the first unit.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

What is claimed is:

1. A method of reducing the moisture content of tobacco, especially burley or greenleaf tobacco, comprising the steps of transporting a continuous stream of moist tobacco along a predetermined path; subjecting successive increments of said stream to a first adjustable heating action in a first portion of said path; measuring the temperature of tobacco downstream of said first portion; comparing the measured temperature with a first reference value; adjusting said first heating action when the measured temperature deviates from said reference value; subjecting successive increments of said stream to a second adjustable heating action in a second portion of said path downstream of said first portion; measuring the temperature of tobacco downstream of said second portion; comparing the measured temperature of twice heated tobacco with a second reference value; adjusting said second heating action when the measured temperature of twice heated tobacco deviates from said second reference value; and adjusting said second heating action when the measured temperature of once heated tobacco deviates from said first reference value so as to intensify said second heating action when the measured temperature of once heated tobacco is less than that denoted by said first reference value and vice versa.

2. A method as defined in claim 1, wherein at least one of said steps of subjecting tobacco to an adjustable heating action includes conveying a heated gas upwardly across tobacco in the respective portion of said path at a rate and pressure such as to convert the respective increments of said stream into a fluidized stream wherein at least some constituents of the stream float in the ascending gas.

3. A method as defined in claim 2, wherein said one step is said first mentioned step of subjecting tobacco to an adjustable heating action and further comprising the steps of monitoring the temperature of heated gas prior to admission into said first portion of said path and adjusting said first mentioned heating action as a function of the monitored temperature of said gas.

4. A method as defined in claim 2, wherein said one step is said last mentioned step of subjecting tobacco to an adjustable heating action and further comprising the steps of monitoring the temperature of heated gas prior to admission into said second portion of said path and adjusting said last mentioned heating action as a function of the monitored temperature of said gas.

5. In an apparatus for reducing the moisture content of tobacco, especially burley or greenleaf tobacco, the combination of means for transporting a continuous stream of tobacco particles along a predetermined path; first adjustable means for heating successive increments of said stream in a first portion of said path; second adjustable means for heating successive increments of said stream in a second portion of said path downstream of said first portion; first and second signal generating detector means for respectively measuring the temperature of tobacco particles downstream of said first and second portions of said path; first and second sources of reference signals respectively denoting the desired temperature of tobacco particles downstream of said first and second portions of said path; first control means including means for adjusting said first heating means as a function of the extent of deviation of signals generated by said first detector means from signals furnished by said first source; and second control means including means for adjusting said second heating means as a function of the extent of deviation of signals generated by said second detector means from signals furnished by said second source as well as a function of said first mentioned deviation so as to intensify the heating action of said second heating means when the temperature measured by said first detector means is less than the desired temperature and vice versa.

6. The combination of claim 5, wherein at least one of said heating means comprises means for conveying an ascending current of hot gas across the respective portion of said path so as to fluidize the particles of tobacco in said last mentioned portion of said path.

7. The combination of claim 6, further comprising signal generating means for monitoring the temperature of said gas prior to admission into the respective portion of said path, the control means for said one heating means including means for comparing the signals generated by said monitoring means with output signals denoting the difference between the signals generated by the respective detector means and the respective reference signal, and for transmitting to the respective adjusting means signals denoting the difference between said output signals and signals generated by said monitoring means.

8. The combination of claim 5, wherein at least one of said detector means is a bolometer.

9. The combination of claim 5, further comprising means for cooling successive increments of said stream in a third portion of said path downstream of said second portion, including means for conveying a current of gaseous coolant across the tobacco stream in said third portion of said path, at least one of said heating means including means for conveying a current of hot gas across the respective portion of said path, and further comprising means for conveying coolant which is preheated by tobacco particles in said third portion of said path to said one heating means.

10. The combination of claim 5, further comprising sensor means operative to deactivate said sources of reference signals in response to detected absence of tobacco particles in said path.

* * * * *